US010813529B2

(12) United States Patent
Lagness et al.

(10) Patent No.: US 10,813,529 B2
(45) Date of Patent: Oct. 27, 2020

(54) DISHWASHER WITH PIVOTING HANDLE

(71) Applicant: Whirlpool Corporation, Benton Harbor, MI (US)

(72) Inventors: Michael W. Lagness, Bridgman, MI (US); Rafael G. Reyes, Saint Joseph, MI (US); Michael S. Seeley, South Haven, MI (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 364 days.

(21) Appl. No.: 15/868,462

(22) Filed: Jan. 11, 2018

(65) Prior Publication Data

US 2018/0132695 A1 May 17, 2018

Related U.S. Application Data

(62) Division of application No. 14/831,304, filed on Aug. 20, 2015, now Pat. No. 9,888,828.

(51) Int. Cl.
*A47L 15/42* (2006.01)
*F24C 15/02* (2006.01)

(52) U.S. Cl.
CPC ..... *A47L 15/4261* (2013.01); *A47L 15/4257* (2013.01); *F24C 15/022* (2013.01); *F24C 15/023* (2013.01); *F24C 15/024* (2013.01)

(58) Field of Classification Search
None
See application file for complete search history.

(56) References Cited

U.S. PATENT DOCUMENTS

| | | | |
|---|---|---|---|
| 1,868,991 | A | 7/1932 | Pickup |
| 2,037,277 | A | 4/1936 | Sheeley |
| 4,082,078 | A | 4/1978 | Thuleen et al. |
| 6,338,352 | B1 | 1/2002 | Raches et al. |
| 2005/0034381 | A1 | 2/2005 | Bartmann et al. |
| 2008/0282504 | A1 | 11/2008 | Baumeister et al. |
| 2014/0035453 | A1 | 2/2014 | Kwon et al. |

FOREIGN PATENT DOCUMENTS

| | | | |
|---|---|---|---|
| DE | 2740462 | A1 | 3/1979 |
| DE | 4344337 | A1 | 6/1995 |
| DE | 102008043365 | A1 | 5/2010 |
| EP | 1560509 | A1 | 8/2005 |
| EP | 2009357 | A1 | 12/2008 |
| EP | 2527749 | A1 | 11/2012 |
| JP | 2005308277 | A | 11/2005 |

*Primary Examiner* — Rita P Adhlakha
(74) *Attorney, Agent, or Firm* — McGarry Bair PC

(57) ABSTRACT

A dishwasher includes a tub at least partially defining a treating chamber with an access opening receiving dishes for treatment, a door moveable between an opened position and a closed position along a predetermined arc for selectively closing the access opening, the door having an interior side that faces the treating chamber in the closed position and an exterior side opposite the interior side and a handle extending from the exterior side of the door where a user may grasp the handle to move the door, and a method of using thereof.

7 Claims, 6 Drawing Sheets

DISHWASHER WITH PIVOTING HANDLE

CROSS-REFERENCE TO RELATED APPLICATION(S)

This application is a divisional application of U.S. patent application Ser. No. 14/831,304, filed Aug. 20, 2015, now U.S. Pat. No. 9,888,828, which is incorporated herein by reference in its entirety.

BACKGROUND OF THE INVENTION

A dishwashing machine is a domestic appliance into which dishes (e.g., plates, bowls, glasses, flatware, pots, pans, bowls, etc.) are placed to be washed. A dishwashing machine includes a cabinet housing a tub with a treating chamber for washing dishes, and a door configured to open and close for providing selective access to the treating chamber. The dishwasher can further include a handle extending from the door to provide users with an accessible mounting that a user may grasp to move the door between the open and closed positions.

BRIEF DESCRIPTION OF THE INVENTION

In one aspect of the invention, a dishwasher includes a tub at least partially defining a treating chamber with an access opening receiving dishes for treatment. The dishwasher has a door that is moveable between an opened position and a closed position along a predetermined arc for selectively closing the access opening. The door has an interior side that faces the treating chamber in the closed position and an exterior side opposite the interior side. A handle is hingedly mounted on the exterior side of the door and is rotatable between a use position, where the handle extends perpendicularly away from the door when the door is in the closed position, and a retracted position, where the handle does not extend perpendicularly away from the door in the open position. The handle comprises a handle hinge pivotally coupling the handle to the door for pivotal movement between the use position and the retracted position. The handle hinge is configured to pivot the handle downwardly from the use position to the retracted position such that a distal end of the handle moves in a direction toward the exterior side of the door. An actuator comprises a mechanical linkage coupled between the hinge and the handle and is configured to hold the handle in the use position when the door is in the closed position. A free motion element is coupled to the mechanical linkage such that the door is free to pivot through a portion of the predetermined arc before the handle begins to pivot when the door is moved from the closed position to the open position.

Another aspect of the invention is a method of controlling the opening of a dishwasher door moveable between an opened position and a closed position along a predetermined arc and having an outer surface with a handle projecting from and hingedly mounted to the outer surface. The method comprises moving the handle from a use position to a retracted position in response to the door being moved from a closed position to an opened position after the door pivots through a portion of the predetermined arc.

DESCRIPTION OF EMBODIMENTS OF THE INVENTION

Figure 1:
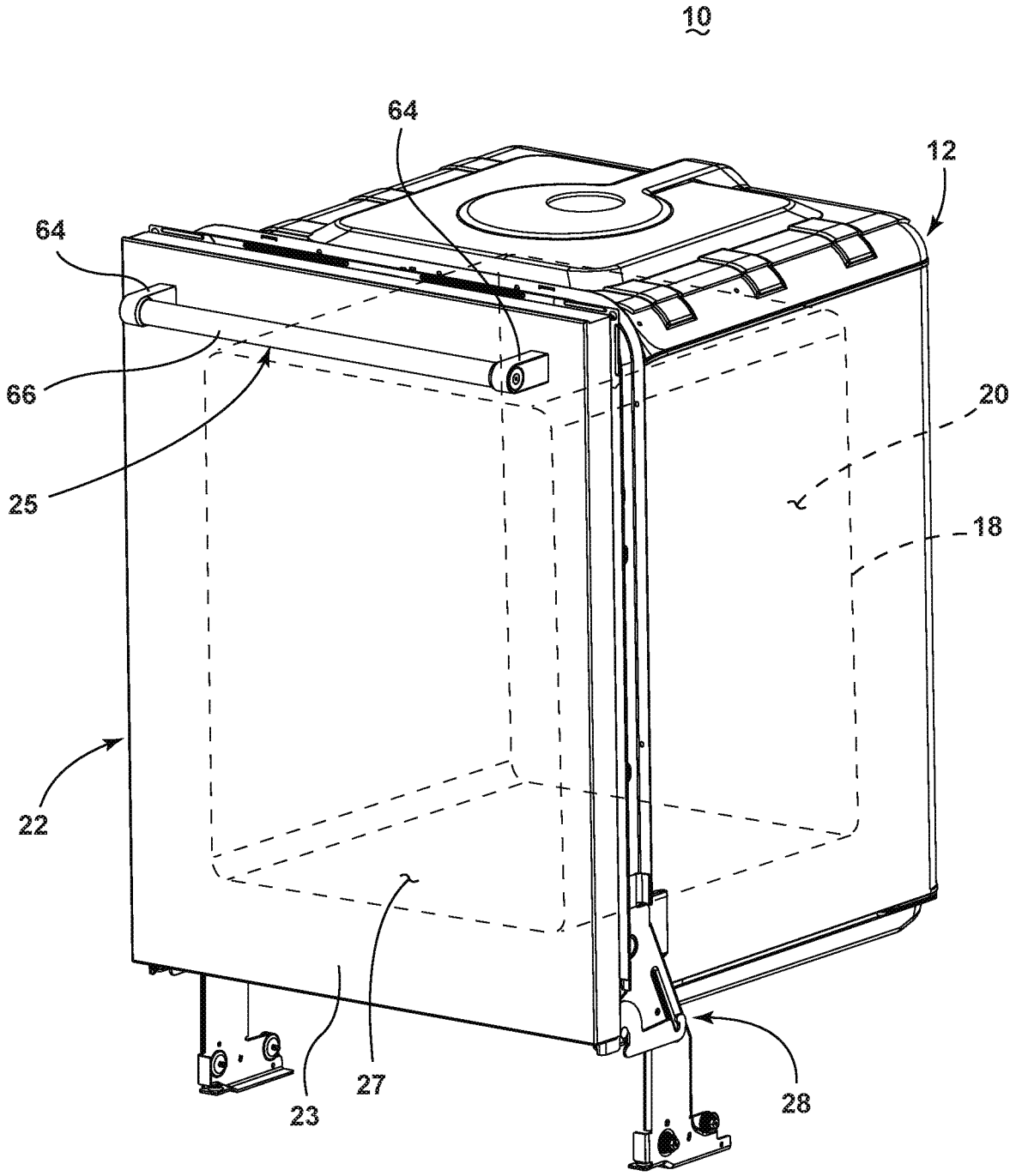
FIG. 1 is a perspective view of a dishwasher having a handle according to one embodiment of the invention.

In FIG. 1, an automated dishwasher 10 according to one embodiment of the invention is illustrated. The dishwasher 10 can treat dishes according to an automatic cycle of operation. Depending on whether the dishwasher 10 is a stand-alone or built-in, a cabinet 12 of the dishwasher 10 can be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A tub 18 is located within the cabinet 12 and at least partially defines a treating chamber 20 with an access opening in the form of an open face. A cover, illustrated as a door assembly 22, can include a door 23 and a door handle 25, wherein the door assembly 22 can be sized and shaped to overlap with the access opening to provide selectable access to the treating chamber 20. For example, the door 23 or door assembly 22 can be hingedly mounted to the cabinet 12 by a pivotable mounting 28 configured to selectively rotate or move the door 23 or door assembly 22 between an opened position, wherein the user can access the treating chamber 20, and a closed position, as shown in FIG. 1, wherein the door 23 or door assembly 22 covers or closes the open face of the treating chamber 20. The door 23 additionally includes an exterior side 27 supporting the door handle 25, which is illustrated extending normally from the exterior side 27. The door handle 25 can include, for example, two spaced handle mounts 64 and a handle bar 66 extending between the handle mounts 64. While shown near the top of door 23, door assembly 22, or exterior side 27, embodiments of the disclosure can include alternative placement of the door handle 25. Another alternative configuration of the door handle 25 can include a handle bar 66 extending along a shorter span of the exterior side 27 of the door assembly 22, or a set of door handles 25 spaced from one another. Additional configurations can be included.

Figure 2:
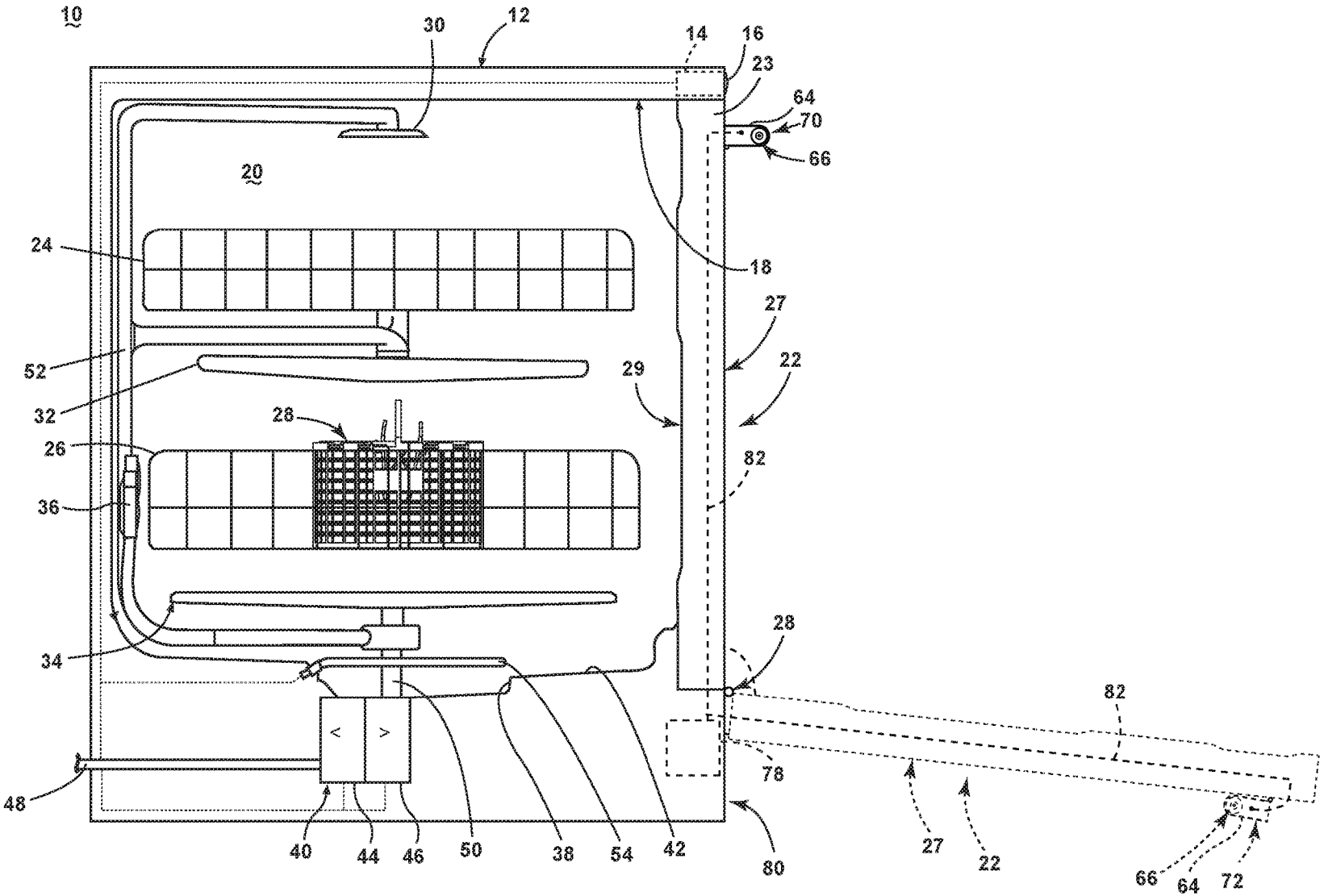
FIG. 2 is a schematic, cross-sectional view of the dishwasher of FIG. 1.

FIG. 2 is a schematic, cross-sectional view of a dishwasher 10 of FIG. 1, illustrating aspects of the treating chamber 20 and door assembly 22. As shown, the door assembly 22 can include an interior side 29, opposed to the exterior side 27, and facing the treating chamber 20 when the door 23 is in the closed position. When closed, the door assembly 22 can be substantially vertical or at least normal relative to a floor surface on which the dishwasher 10 rests. When the door assembly 22 is open (illustrated in dotted line), the interior side 29 faces upwardly, and the exterior side 27 faces downwardly, such as toward a floor surface on which the dishwasher 10 rests. When open, the door assembly 22 can be substantially horizontal, or parallel to the floor surface on which the dishwasher 10 rests, or can be opened beyond a horizontal or parallel position (e.g. can be opened or rotated past a 90 degrees), or can be opened to a position less than horizontal (e.g. opened to a maximum angle of less than 90 degrees, such as 86 degrees).

The door handle 25 is illustrated in a use position 70 while the door assembly 22 is in the closed position and a retracted position 72 when the door assembly 22 is in the opened position. As used herein, the door handle 25 in the "use position" 70 denotes when the handle 25 is extended normally away from the door 23 or door assembly 22 such that a user can grasp the handle 25 to move the door 23 or door assembly 22 between the opened position and the closed position. Also as used herein, the door handle 25 in the "retracted position" 72 denotes when the handle 25 is located closer to the exterior side 27 of the door 23 or door assembly 22, compared with the use position 70. The dishwasher 10 can further include an actuator 78 coupled with the door handle 25 by way of a mechanical linkage mechanism, such as a cable 82, and can be configured for moving the door handle 25 between the use position 70 and the retracted position 72. The actuator 78 is illustrated schematically in a base 80 of the dishwasher 10.

A controller 14 can be located within the cabinet 12 and can be operably coupled with various components of the dishwasher 10 to implement one or more cycles of operation. A control panel or user interface 16 can be provided on the dishwasher 10 and coupled with the controller 14. The user interface 16 can include operational controls such as dials, lights, switches, and displays enabling a user to input commands, such as a cycle of operation, to the controller 14 and receive information.

Dish holders in the form of upper and lower racks 24, 26 are located within the treating chamber 20 and receive dishes for treatment. The racks 24, 26 are mounted for slidable movement in and out of the treating chamber 20 for ease of loading and unloading. As used in this description, the term "dish(es)" is intended to be generic to any item, single or plural, that can be treated in the dishwasher 10, including, without limitation; utensils, plates, pots, bowls, pans, glassware, and silverware. Additional racks and/or utensil holders can also be provided.

A spraying system can be provided for spraying liquid into the treating chamber 20 and is illustrated in the form of an upper sprayer 30, a mid-level rotatable sprayer 32, a lower rotatable sprayer 34, and a spray manifold 36. The upper sprayer 30 can be located above the upper rack 24 and is illustrated as a fixed spray nozzle that sprays liquid downwardly within the treating chamber 20. The mid-level rotatable sprayer 32 is located between the upper rack 24 and the lower rack 26 and is illustrated as a rotating spray arm. The mid-level spray arm 32 can provide a liquid spray upwardly through the bottom of the upper rack 24. The mid-level rotatable sprayer 32 can optionally also provide a liquid spray downwardly onto the lower rack 26. The lower rotatable sprayer 34 is located underneath the lower rack 26 and can provide a liquid spray upwardly through the bottom of the lower rack 26.

The spray manifold 36 can be fixedly mounted to the tub 18 adjacent to the lower rack 26 and can provide a liquid spray laterally through a side of the lower rack 26. The spray manifold 36 cannot be limited to this position; rather, the spray manifold 36 can be located in virtually any part of the treating chamber 20. While not illustrated herein, the spray manifold 36 can include multiple spray nozzles having apertures configured to spray wash liquid towards the lower rack 26. The spray nozzles can be fixed or rotatable with respect to the tub 18.

A liquid recirculation system can be provided for recirculating liquid from the treating chamber 20 to the spraying system. The recirculation system can include a sump 38 and a pump assembly 40. The sump 38 collects the liquid sprayed in the treating chamber 20 and can be formed by a sloped or recessed portion of a bottom wall 42 of the tub 18. The pump assembly 40 can include both a drain pump 44 and a recirculation pump 46.

The drain pump 44 can draw liquid from the sump 38 and pump the liquid out of the dishwasher 10 to a household drain line 48. The recirculation pump 46 can draw liquid from the sump 38 and pump the liquid to the spraying system to supply liquid into the treating chamber 20. While the pump assembly 40 is illustrated as having separate drain and recirculation pumps 44, 46 in an alternative embodiment, the pump assembly 40 can include a single pump configured to selectively supply wash liquid to either the spraying system or the drain line 48, such as by configuring the pump to rotate in opposite directions, or by providing a suitable valve system. While not shown, a liquid supply system can include a water supply conduit coupled with a household water supply for supplying water to the sump 38.

As shown herein, the recirculation pump 46 has an outlet conduit 50 in fluid communication with the spraying system for discharging wash liquid from the recirculation pump 46 to the sprayers 30-36. As illustrated, liquid can be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it can fluidly communicate with one or more manifold tubes that directly transport liquid to the spray manifold 36, mid-level rotatable sprayer 32, and upper sprayer 30. Further, diverters (not shown) can be provided within the spraying system such that liquid can be selectively supplied to each of the sprayers 30-36. The sprayers 30-36 spray water and/or treating chemistry onto the dish racks 24, 26 (and hence any dishes positioned thereon) to effect a recirculation of the liquid from the treating chamber 20 to the liquid spraying system to define a recirculation flow path.

A heating system having a heater 54 can be located within or near the sump 38 for heating liquid contained in the sump 38. A filtering system (not shown) can be fluidly coupled with the recirculation flow path for filtering the recirculated liquid.

Figure 3:
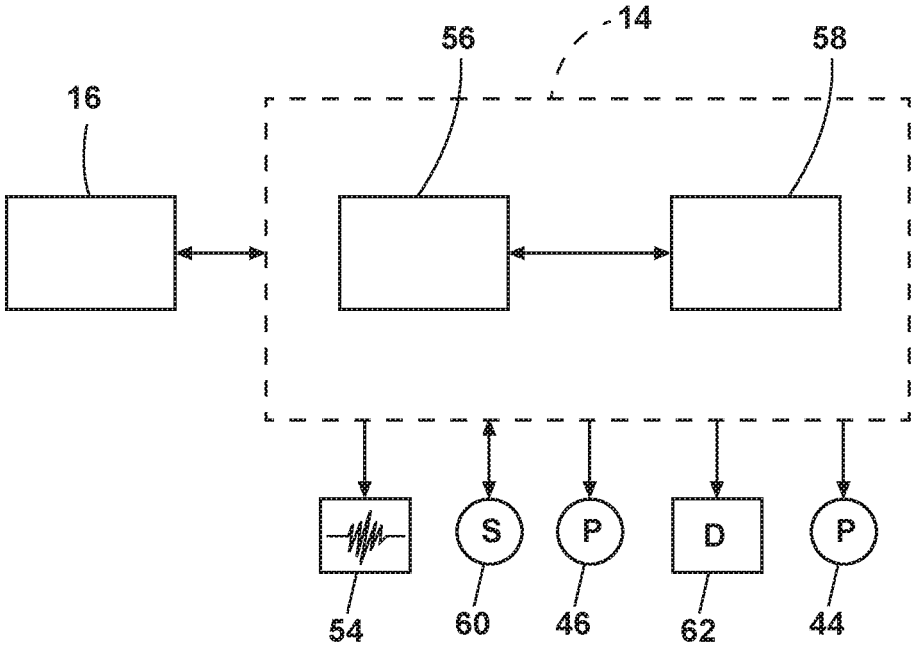
FIG. 3 is a schematic view of a control system of the dishwasher of FIG. 1.

As illustrated in FIG. 3, the controller 14 can be provided with a memory 56 and a central processing unit (CPU) 58. The memory 56 can be used for storing control software that can be executed by the CPU 58 in completing a cycle of operation using the dishwasher 10 and any additional software. For example, the memory 56 can store one or more pre-programmed cycles of operation that can be selected by a user and completed by the dishwasher 10. A cycle of operation for the dishwasher 10 can include one or more of the following steps: a wash step, a rinse step, and a drying step. The wash step can further include a pre-wash step and a main wash step. The rinse step can also include multiple steps such as one or more additional rinsing steps performed in addition to a first rinsing. The amounts of water and/or rinse aid used during each of the multiple rinse steps can be varied. The drying step can have a non-heated drying step (so called "air only"), a heated drying step or a combination thereof. These multiple steps can also be performed by the dishwasher 10 in any desired combination.

The controller 14 can be operably coupled with one or more components of the dishwasher 10 for communicating with and controlling the operation of the components to complete a cycle of operation. For example, the controller 14 can be coupled with the recirculation pump 46 for circulation of liquid in the tub 18 and the drain pump 44 for drainage of liquid in the tub 18. The controller 14 can also be operably coupled to the heater 54. Further, the controller 14 can also be coupled with one or more optional sensors 60. Non-limiting examples of optional sensors 60 that can be communicably coupled with the controller 14 include a moisture sensor, a door sensor, a temperature sensor, a detergent and rinse aid presence/type sensor(s). The controller 14 can also be coupled to a dispenser 62, which can dispense a detergent during the wash step of the cycle of operation or a rinse aid during the rinse step of the cycle of operation.

Figure 4:
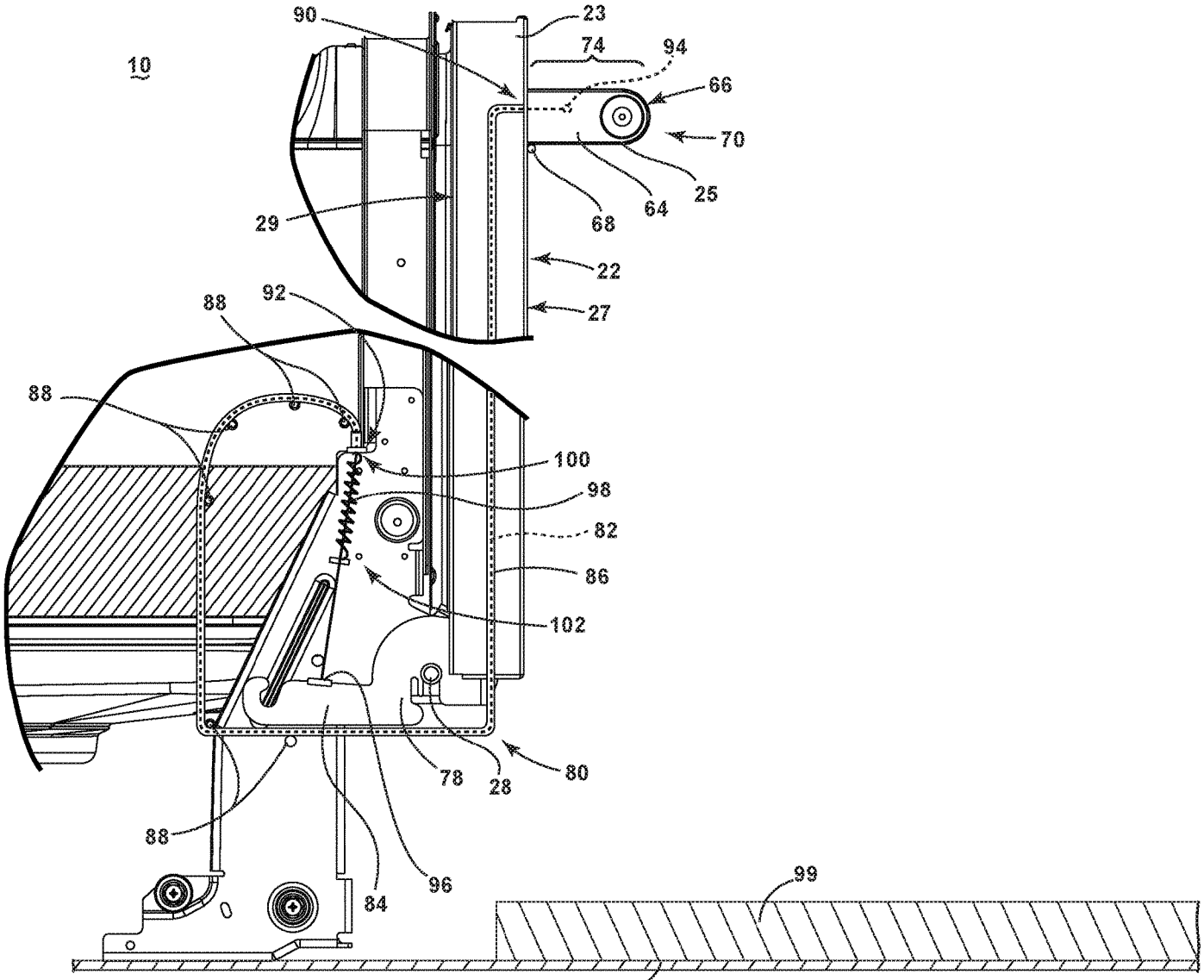
FIG. 4 is a detailed cross-sectional view of the door assembly, actuator, and handle of the dishwasher of FIG. 1 when the door assembly is in the closed position.

FIG. 4 illustrates a detailed cross-sectional view of aspects of the door assembly 22 and the actuator 78 when the door is in the closed position. The view additionally illustrates the door assembly 22 relative to a floor surface 77 or a step 99 proximate to the door 23 and having a higher elevation than the floor surface 77 which supports the dishwasher 10. As shown, the door handle 25 or handle mount 64 can include a hinge 68 positioned on the lower portion of the handle mount 64, between the mount 64 and the door assembly 22. The hinge 68 can be configured for pivotally mounting the door handle 25 or handle mount 64 to the exterior side 27 of the door 23 or door assembly 22 such that the door handle 25 can pivot between the use position 70 and the retracted position 72. The door handle 25 configured in the use position 70 can define a first clearance 74 or length of the door handle 25 protruding from or extending away from the exterior side 27 of the door 23. While only a single hinge 68 is illustrated in the profile cross-sectional view, each handle mount 64 can include a hinge.

The actuator 78 can include the pivotable mounting 28 or hinge coupling the door assembly 22 with the dishwasher 10. The actuator 78 can operably move the door handle 25 between the use position 70 and the retracted position 72 by way of a mechanical tension or mechanical linkage mechanism, such as the cable 82, extending through at least a portion of the base 80, pivotable mounting 28, or door assembly 22, and coupling the actuator 78 with the door handle 25. While a cable 82 is described, alternative mechanical tension or mechanical linkage mechanisms can be included. The actuator 78 or pivotable mounting 28 can additionally include a door hinge, or arm mechanism 84, that is rotatably coupled with the door 23 such that the door 23 and the arm mechanism 84 can co-rotate about the pivotable mounting 28.

Also illustrated in detail is the tension mechanism or cable 82. As shown herein, the cable 82 can extend through a protective sheath 86 running through the door assembly 22 and base 80 of the dishwasher 10. The protective sheath 86 can be configured to shield the cable 82 from components of the dishwasher 10 that can otherwise catch, pinch, or damage the cable 82. The sheath 86 and cable 82 are configured such that the sheath 86 can be fixedly coupled with the dishwasher 10, the door assembly 22, of the base 80 by way of mounting elements 88 such as ties, fasteners, grips, hooks, latches, or the like, while allowing the cable 82 to independently move within the sheath 86 based at least on the tension in the cable 82. The sheath 86 can be, for example, fixedly terminated or anchored at a first end 90 positioned proximate to the door handle 25, and at a second end 92 in the base 80, proximate to the arm mechanism 84.

The cable 82 can be likewise fixedly terminated, coupled, or anchored at a first end 94 located in the door handle 25 and a second end 96 coupled with the arm mechanism 84. At least a portion of the cable 82 can further include a tensioning element, such as a mechanical spring 98. The spring 98 can be located in-line with the cable 82, and can be coupled with or anchored at a first end 100 by, for example, the same anchoring element at the second end 92 of the sheath 86, and at a second end 102 by a fixed mounting with the cable 82 between the spring first end 100 and the cable second end 96. The spring 98 can include an extension spring, that is a spring 98 biased to draw the first end 100 and the second end 102 proximate to each other.

As illustrated, the cable 82, actuator 78, door assembly 22, spring 98, and cable 82 can be operably configured such that when the door assembly 22 is in the closed position, the anchoring of the second end 96 of the cable 82 subjects the cable 82 to tension. In this sense, the length of the cable 82 can be configured or adjusted at one of the first or second ends 94, 96 to remove any slack or excess cable 82 length while under tension. While the cable 82 is under tension, the door handle 25 is drawn by the anchoring of the first end 94 of the cable 82 such that the handle 25 pivots about the handle hinge 68 to extends normally away from the door assembly 22 in the use position 70. Additionally, while the cable 82 is under tension, the spring 98 is extended, that is, extended opposed to the spring 98 bias, by the configuration of the first and second end 100, 102 mountings. Thus, the spring 98 is additionally under tension while the door assembly 22 is in the closed position.

Figure 5:
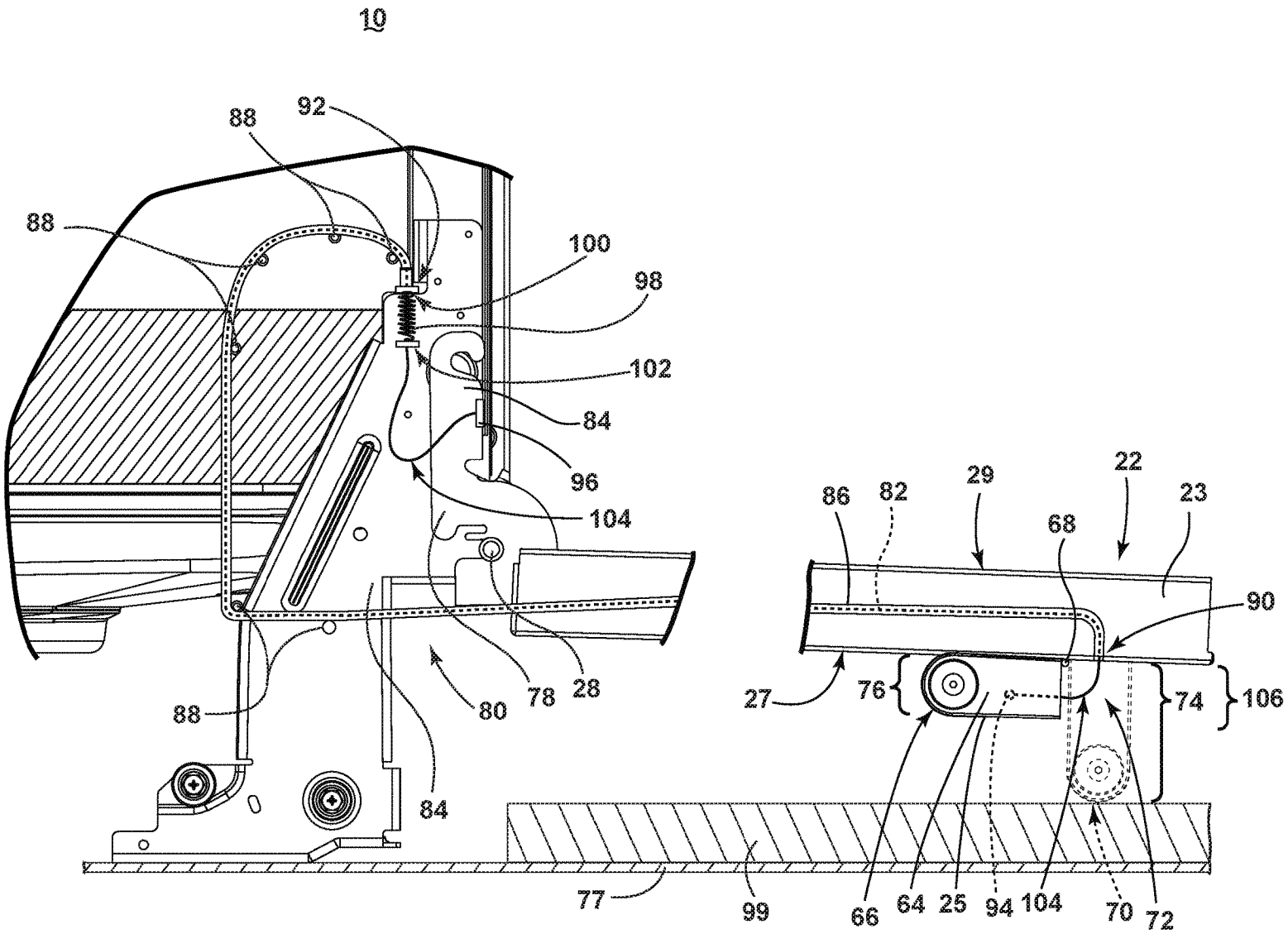
FIG. 5 is a detailed cross-sectional view of the door assembly, actuator, and handle of the dishwasher of FIG. 1 when the door assembly is in the opened position.

FIG. 5 illustrates the detailed cross-sectional view of aspects of the door assembly 22 and the actuator 78 of FIG. 4, when the door is in the opened position and the door handle 25 is in the retracted position 72. The door handle 25 in the retracted position 72 can define a second clearance 76 of the door handle 25 protruding from or extending away from the exterior side 27 of the door 23, wherein the first clearance 74 of the door handle 25 is longer, larger, protrudes from, or extends away from the exterior side 27 farther than the second clearance 76 of the door handle 25. While the door handle 25 in the retracted position 72 is illustrated adjacent to the exterior side 27, or not stored within the door 23, non-limiting alternative embodiments of the disclosure can include configurations wherein the door handle 25 can be, for instance, partially or fully received within the door 23 while in the retracted position 72. These alternative embodiments can provide for an even smaller or shorter second clearance 76.

As illustrated, when the door assembly 22 is rotated to open, the rotatably coupled arm mechanism 84 also rotates such that the cable 82 is no longer under tension, as illustrated by slack 104 in the cable 82. At least a portion of the slack 104 is drawn through the protective sheath 86 by the bias of the spring 98. The portion of the slack 104 drawn through the protective sheath 86 can extend through the base 80 of the dishwasher 10 and through the door 23, such that slack 104 is also present between the first end 94 of the cable 82 and the first end of the sheath 86. As the door handle 25 is no longer drawn by cable 82 tension to extend normally from the door assembly 22, the door handle 25 is free to rotate about the handle hinge 68 to the retracted position 72.

Embodiments of the disclosure can be included wherein, for example, the handle hinge 68 can further include a spring-loaded hinge biased toward, or biasing the door handle 25 toward, the retracted position 72. In such a configuration, any slack 104 on the cable 82 can be drawn into the protective sheath 86 by the spring 98, and ultimately supplied as slack 104 between the first end of the cable 82 and the first end of the sheath 86, allowing the spring-loaded hinge 68 to bias the door handle 25 toward the retracted position 72.

As shown, when the door assembly 22 is in the opened position, the distance between the exterior side 27 of the door 23 and the floor surface 77 or the step 99 on which the dishwasher 10 rests defines a third clearance 106 that is greater than the second clearance 76 of the door handle 25 in the retracted position 72. However, the third clearance 106 is less than the first clearance 74 of the door handle 25 in the use position 70, as illustrated in dotted outline. Embodiments of the disclosure described herein provide for dishwasher 10 configuration wherein the door handle 25 automatically moves from the use position 70 to the retracted position 72 when the door assembly 22 is moved from the closed position to the open position. The automatic movement of the door handle 25 into the retracted position 72 provides a smaller clearance 76 of the door handle 25 relative to the floor surface 77 or the step 99 than the clearance 74 of the door handle 25 relative to the floor surface 77 or the step 99 in the use position 70. The smaller clearance 76 provided for herein, thus allows for a dishwasher 10 configuration wherein the door assembly 22 or door 23 can be opened wider, that is, wherein the door can be opened with a smaller clearance 106 relative to the floor surface 77 or the step 99, than conventional dishwasher configurations. Stated another way, the distance between the door 23 and the floor surface 77 or the step 99 in the opened position (i.e. the door handle 25 in the retracted position 72) is less than the maximum distance from the door 23 to the door handle 25 in the closed position (i.e. the door handle 25 in the use position 70).

Embodiments of the disclosure can include configurations wherein the spring 98, cable 82, protective sheath 86, or various anchoring or mounting positions are configured to provide sufficient tension to position the door handle 25 in the use position 70 when the door assembly 22 is in the closed position, and are configured to provide sufficient slack 104 to allow the door handle 25 to be positioned in the retracted position 72 when the door assembly 22 is in the opened position. The automatic movement of the door handle 25 from the use position 70 to the retracted position 72 can occur, for example, linearly along the full transitioning of the door assembly 22 from the closed position to the opened position (and vice versa).

Alternatively, the spring 98, cable 82, protective sheath 86, or various anchoring or mounting positions can be configured such that the automatic movement of the door handle 25 from the use position 70 to the retracted position 72 can occur over only a portion of the transitioning of the door assembly 22 from the closed position to the opened position (and vice versa). For instance, alternative embodiments can be configured to provide sufficient slack 104 on the cable 82 such that the door handle 25 is positioned in the retracted position prior to the door assembly 22 reaching the fully opened position.

In another alternative embodiment of the disclosure, the cable 82, mechanical linkage, or actuator 78 can include a free motion element, such as a tensioner pulley to apply additional or variable pressure or tension against the cable 82. The additional or variable tension provided by the free motion element can be configured to allow an initial or partial pivoting of the door assembly 22 about the pivotable mounting 28, from the closed position through a predetermined arc toward the opened position before the free motion element allows for a reduction in tension in the cable 82. This "delay" of releasing tension in the cable 82 while moving the door assembly 22 through the predetermined arc can correspondingly or operably "delay" the start of transitioning or pivoting of the door handle 25 from the use position 70 to the retracted position 72. In this sense, the door assembly 22 can be free to pivot through the predetermined arc before the door handle 25 begins to pivot. Non-limiting examples of the predetermined arc can include an arc of at least 45 degrees, or between 45 and 60 degrees of door 23 movement from the closed position towards the opened position before the door handle 25 begins to pivot about the handle hinge 68.

While a tensioner pulley is described, alternative free motion elements can include configurations wherein, for example, a compression spring biased to extend to a first length, wherein the cable 82 is coupled between the door handle 25 and through the compression spring. The compression spring can be located in line with the rotation of the arm 84, such that rotation of the arm 25 contacts and compresses the compression spring as the door is moved from the closed position to the opened position. The compression of the compression spring in turn provides slack on the cable 82, which allows the door handle 25 to transition into the retracted position 72, as described herein. In this configuration, the position of the spring relative to the contact of the arm 84 during rotation can be positioned such that the spring does not provide the slack on the cable 82 until an appropriate predetermined arc of door movement. Additional configurations can be included.

In yet another alternative embodiment of the disclosure, a locking mechanism can be placed in-line with the cable 82 or mechanical linkage such that the door handle 25 in the use position 70 can be selectively "locked" or held against the door 23 while the door assembly 22 is in or near the closed position. The locking mechanism can be utilized to provide or supplement the tension holding the door handle 25 against the door 23. The "locking" described herein can prevent or reduce variations in cable 82 tension over the length of the cable 82 when a user grips and exerts a force upon the door handle 25, such as opening the door 23. The locking mechanism can be configured to "release" the lock (i.e. unlock) in response to, for example, a sufficient amount of slack 104 generated on the cable 82, or the door assembly 22 rotating past the predetermined arc, as described above. In this configuration, the door handle 25 would be prevent from transitioning from the use position 70 to the retracted position 72 until the locking mechanism is "unlocked."

Figure 6:
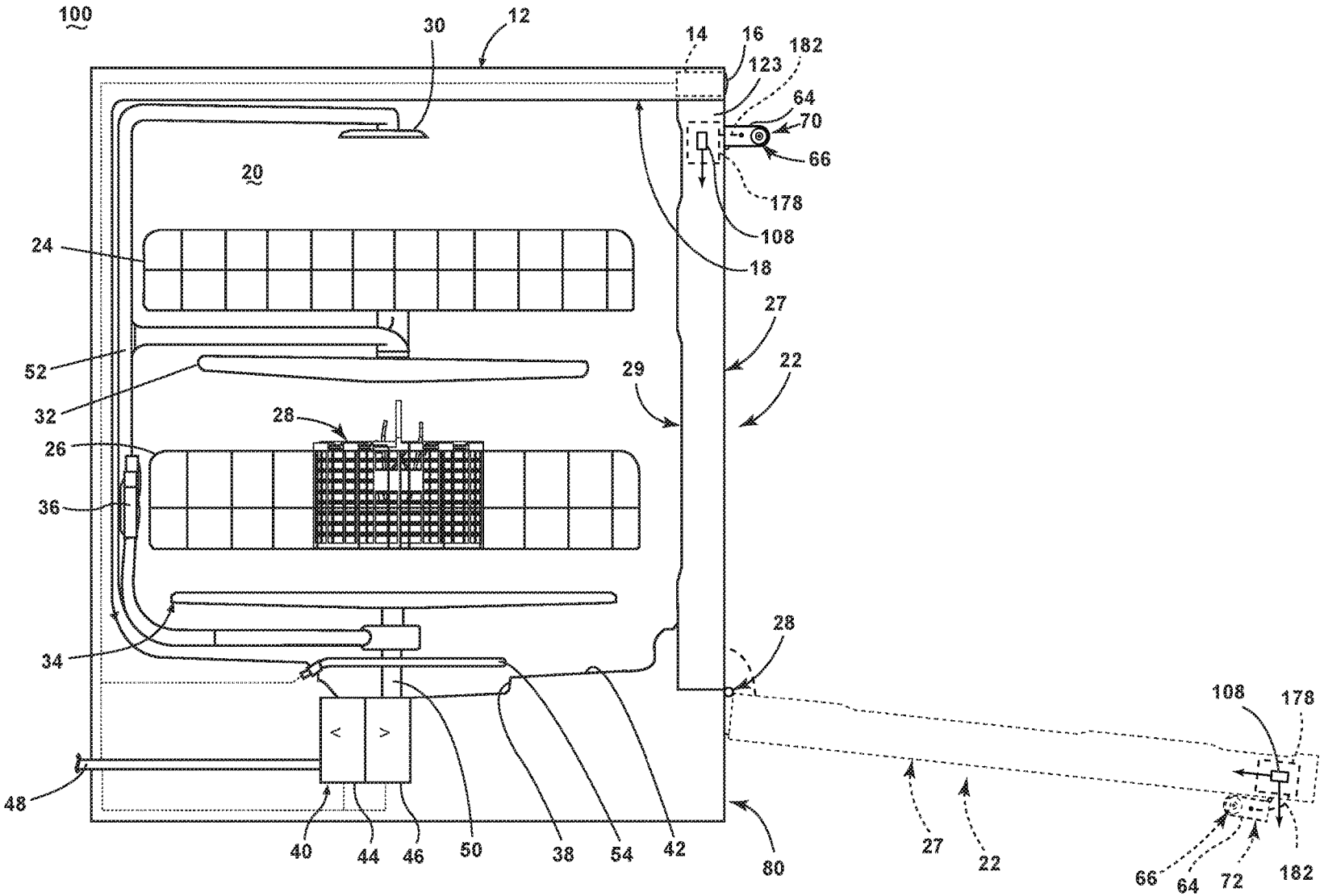
FIG. 6 is a schematic, cross-sectional view of a second embodiment of the dishwasher.

FIG. 6 illustrates an alternative dishwasher 110 according to a second embodiment of the disclosure. The second embodiment has some similarities to the first embodiment; therefore, like parts will be identified with like numerals increased by 100, with it being understood that the description of the like parts of the first embodiment applies to the second embodiment, unless otherwise noted. A difference between the first embodiment and the second embodiment is that the actuator 178 can include an electromechanical actuator 178, such as a motor, stepper motor, servo motor, or the like. As shown, the actuator be located in the door assembly 123 and can, for example, include a positional sensor or gyroscope 108. The gyroscope 108 can be configured to sense or measure the angle opening of the door assembly 123, and can controllably operate the electromechanical actuator 178, which is coupled with the handle mount 64, for example, by way of the cable 182. In one example embodiment of the disclosure, when the door assembly 123 is in the closed position, the gyroscope 108 senses the door is in the closed position, which can control the electromechanical actuator 178 to retract the handle mount 64 into the use position 70. When the door assembly 123 is in the open position, the gyroscope 108 can sense the door is in the opened position, or that after an opening "delay" in the start of transitioning the handle mount 64, as described herein, the electromechanical actuator 178 can control the tension of the cable 182 such that the handle mount 64 moves into the retracted position 72. While a gyroscope 108 is described, alternative methods or sensors can be included wherein the method or sensor provides indication to an electromechanical actuator 178 that the door is in the opened or closed positions, or any positions there between. Additionally, embodiments of the disclosure can include alternative placement of the gyroscope 108 or like element, such as external to the actuator 178, in the door assembly 123, or the like.

Embodiments of the disclosure described herein can additionally be utilized to perform a method of controlling the opening of a dishwasher 10 door assembly 22 or door 23, wherein the method includes automatically retracting the door handle 25 from a use position 70 toward the exterior side 27 or outer surface of the door 23 to a retracted position 72 in response to the door 23 being moved from the closed position to a fully opened position. Additionally, while only a single cross-sectional perspective has been illustrated in FIGS. 4 and 5, embodiments of the disclosure are envisioned wherein each side of the cabinet 12, each handle mount 64, or each pivotable mounting 28 of the dishwasher 10 can be configured to include the aforementioned cable 82, actuator 78, and the like to enable the automatic transitioning of the door handle 25 described herein.

The embodiments disclosed herein provide a dishwasher having an automatically retracting handle when the door is moved from the closed position to the open position, and method for operating thereof. One advantage that can be realized in the above embodiments is that the above-described embodiments provide for a door handle that automatically retracts while the door is in the opened position, and wherein the clearance of the retracted handle is less than the clearance of handle in the use position. A smaller or shorter clearance allows for embodiments of the disclosure wherein the dishwasher door can, for example, be configured closer to the floor surface while opened, or be configured to open at a greater total arc (e.g. greater than 90 degrees of rotation). Alternatively, a smaller or shorter clearance allows for embodiments of the disclosure wherein the door handle does not abut objects or environment near the dishwasher. For example, floor elevation differences between the base of the dishwasher and where the dishwasher door opens can result in less desirable usability. Additionally, by altering the clearance of the door handle while opening, the likelihood of the door handle contacting a user's foot, or other objects is reduced. The resulting configurations can provide greater access to the treating chamber, wherein a user can easily access the dishes, utensils, or baskets contained therein. Greater access to the treating chamber can allow for design and implementation of a larger treating chamber volume than a similarly sized dishwasher with a conventional door and door handle.

Another advantage of the above-described embodiments is that the above embodiments provide for the reduced clearance when the door is in the opened position, but can still provide for the automatic configuration of the door handle in the use position during the opening or closing motions of the door, wherein a user may gasp the handle as needed. Thus, the embodiments of the disclosure allow for reduced clearance of the door and handle when the handle is not needed, while allowing a user access to the handle when the handle is needed.

Yet another advantage of the above-described embodiments is that the above embodiments allow for a configurable delay in handle retraction over an initial arc when opening the door from the closed position. The delay in handle retraction can be configured to provide a user with an initial arc of full handle access, allowing a user to, for example, remove their hand or fingers prior to the retraction to prevent harm or pinching of the user during the retraction.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Moreover, while "a set of" various elements have been described, it will be understood that "a set" can include any number of the respective elements, including only one element. Combinations or permutations of features described herein are covered by this disclosure.

This written description uses examples to disclose embodiments of the invention, including the best mode, and also to enable any person skilled in the art to practice embodiments of the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dishwasher comprising:

a tub at least partially defining a treating chamber with an access opening;

a door moveable between an opened position and a closed position along a predetermined arc for selectively closing the access opening, the door having an interior side that faces the treating chamber in the closed position and an exterior side opposite the interior side;

a handle hingedly mounted on the exterior side of the door and rotatable between a use position, where the handle extends perpendicularly away from the door when the door is in the closed position, and a retracted position, where the handle does not extend perpendicularly away from the door in the open position, wherein the handle comprises a handle hinge pivotally coupling the handle to the door for pivotal movement between the use position and the retracted position; the handle hinge configured to pivot the handle downwardly from the use position to the retracted position such that a distal end of the handle moves in a direction toward the exterior side of the door;

an actuator comprising a mechanical linkage coupled to the handle and configured to hold the handle in the use position when the door is in the closed position;

wherein the door is configured to pivot through a portion of the predetermined arc before the handle begins to pivot when the door is moved from the closed position to the opened position.

2. The dishwasher according to claim 1 wherein the mechanical linkage comprises a cable having a first end coupled with the actuator and a second end coupled with the handle, wherein the cable is configured such that the cable is under tension when the door is in the closed position and includes slack when the door is in the open position.

3. The dishwasher according to claim 2 wherein the cable is under a variable tension.

4. The dishwasher of claim 2 further comprising a locking mechanism coupled to the cable for selectively holding the door while the door is in the closed position.

5. The dishwasher according to claim 1 wherein the predetermined arc is at least 45 degrees.

6. The dishwasher according to claim 1 wherein the handle comprises two spaced handle mounts on the exterior side of the door and a handle bar extending between the handle mounts wherein the distal end of the handle is defined by the handle bar.

7. The dishwasher according to claim 6 wherein the handle mounts are pivotally mounted to the exterior side of the door for movement between the use position and the retracted position.

* * * * *